US005927841A

United States Patent [19]

Ferrari et al.

[11] Patent Number: 5,927,841

[45] Date of Patent: Jul. 27, 1999

[54] ELEMENT FOR MANUFACTURING FURNITURE DRAWERS

[75] Inventors: Franco Ferrari, Località Deviscio, 2, 23900 Lecco; Carlo Migli, Lecco, both of Italy

[73] Assignee: Franco Ferrari, Italy

[21] Appl. No.: 09/005,463

[22] Filed: Jan. 12, 1998

[30] Foreign Application Priority Data

Jan. 21, 1997 [IT] Italy ..... MI970032 U

[51] Int. Cl.[6] ..... A47B 88/00

[52] U.S. Cl. ..... 312/348.1; 312/330.1

[58] Field of Search ..... 312/348.1, 348.2, 312/330.1, 257.1, 258, 108, 111; 403/282, 274, 402, 403, 230, 231, 251, 247, 298, 292

[56] References Cited

U.S. PATENT DOCUMENTS

| | | | |
|---|---|---|---|
| 3,315,834 | 4/1967 | Nemlich | 312/330.1 X |
| 3,958,389 | 5/1976 | Whiteside et al. | 52/758 D X |
| 4,466,675 | 8/1984 | Ferdinand et al. | 312/263 X |
| 5,439,285 | 8/1995 | Lautenschlager | 312/348.1 X |
| 5,618,091 | 4/1997 | Huber et al. | 312/348.1 X |
| 5,709,444 | 1/1998 | Fitz et al. | 312/348.2 X |

*Primary Examiner*—Milton Nelson, Jr.
*Assistant Examiner*—Brian H. Buck
*Attorney, Agent, or Firm*—Shlesinger, Fitzsimmons & Shlesinger

[57] ABSTRACT

An element 10 for manufacturing a drawer is made of a bordered strip (11, 111, 211, 311, 411) which can be folded crosswise to its extension along scored lines (12, 13) to form the sides of a drawer. The strip has, on a first face, a rib (14) close to one edge of the strip and extending longitudinally to the extension of the strip. The rib (14) is designed to fit into a groove (16) along the side of the base of the drawer. Disposed on the opposite face of the strip are runners (18, 19) secured to the strip a by fastening device (23, 24) which traverse the strip to be at least partially contained in the cross section of the rib (14).

9 Claims, 2 Drawing Sheets

ELEMENT FOR MANUFACTURING FURNITURE DRAWERS

BACKGROUND OF THE INVENTION

This invention refers to an element for manufacturing furniture drawers. In particular, the invention refers to a structural element in aluminum, which can be folded to form the various sides of the drawer and comprising runners for the drawer.

The drawers most widely used in the furniture industry are composed of a body in wood and a system of metal runners which enable it to slide within the furniture unit. Drawers have also been proposed at least partially made of metal, for example with side panels and rear panel in metal and the bottom and front panel in wood or other material.

Assembling the metal parts with the rest of the drawer is usually quite costly and/or leads to aesthetical results which are not always satisfactory. For example, in the case of elements in thin sheet metal, the runners are independent and can be secured in place only after the drawer has been assembled. In the case of separate sides, it is also necessary to provide additional elements to connect the sides to each other.

The general scope of this invention is to obviate the above-mentioned problems by providing a metal element which enables drawers to be manufactured quickly and inexpensively.

SUMMARY OF THE INVENTION

This scope is achieved according to the invention by providing an element for manufacturing a drawer composed of a structural strip which can be folded crosswise to its extension along scored lines to form the sides of a drawer, the strip having on a first face a first rib close to one edge of the strip and extending longitudinally to the extension of the strip, the rib being designed to fit into a groove along the side of the base of the drawer, and on the opposite face runners secured to the strip by fastening means traversing the strip to be at least partially contained in the cross section of the rib.

BRIEF DESCRIPTION OF THE DRAWINGS

The innovative principles of this invention and its advantages with respect to the known technique will be more clearly evident from the following description of possible exemplificative and non-restrictive embodiments applying such principles, with reference to the accompanying drawings, in which.

DETAILED DESCRIPTION OF THE INVENTION

Figure 1:
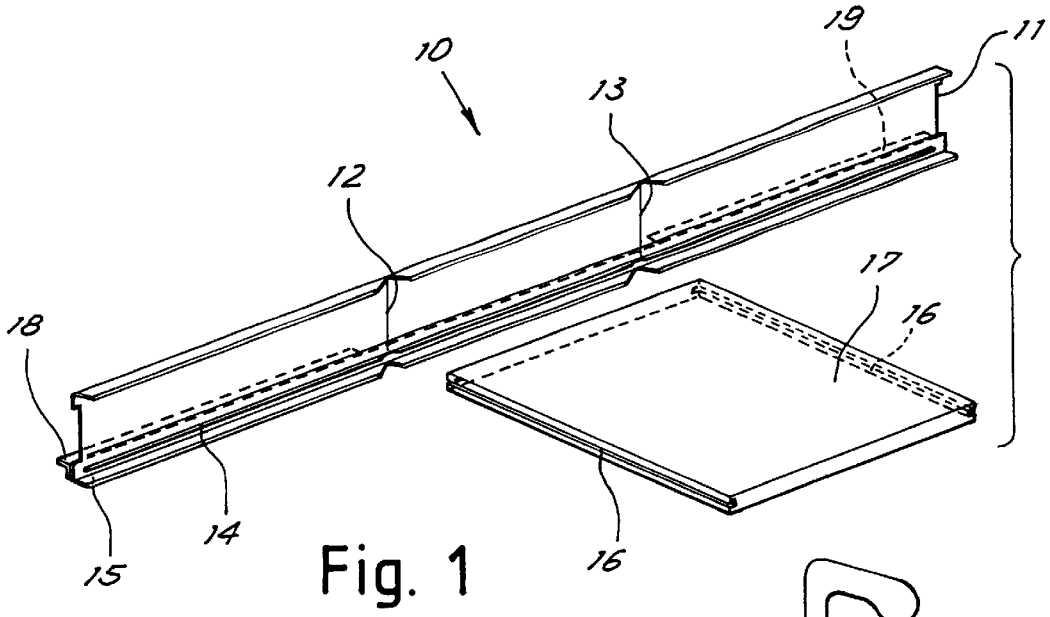
FIG. 1 shows a perspective view of an element made according to the invention, in a extended position and exploded from the base of a drawer.

With reference to the figures, FIG. 1 shows an element, generically indicated by reference 10, for manufacturing a drawer. The element 10 is composed of a bordered strip 11, advantageously made of aluminum, which can be folded crosswise to its extension along scored lines 12, 13 (for example milled) into three sections to form the back and sides of a drawer. The folder strip 11 has, on a first face of each section thereof, a first rib 14 close to one edge 15 of the strip and extending longitudinally to the extension of the strip. Two of the ribs 14 are designed to fit into grooves 16 formed along opposite side of the base 17 of a drawer.

As will be clear further on, disposed on the opposite face of the first and third section of strip 11 are runners 18, 19 which are secured to the strip 11 by fastening means which traverse the strip to be at least partially contained in the cross section of the rib 14.

The expression "contained in the cross section" is understood to mean that the fastening means traversing the strip protrude from its plane in an area substantially facing a cross section of the rib. This area can be contained within the rib or not. This will be clear from the examples of embodiments described below.

Figure 2:
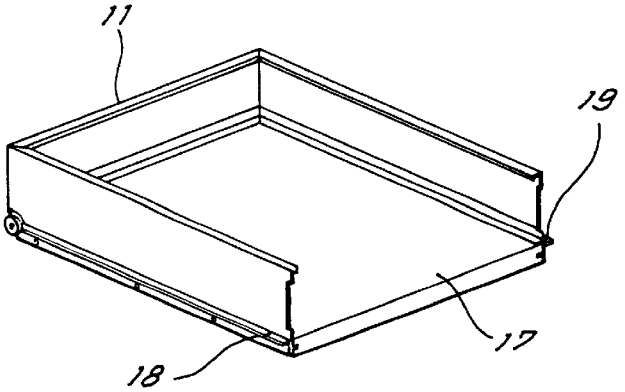
FIG. 2 shows a perspective view of the element of FIG. 1 folded and fitted onto the base of a drawer.

FIG. 1 shows an element for forming the back and two sides of the drawer. For this reason the scored lines are two in number, so as to enable the strip 11 to be folded into a U shape. The arms of the U form opposing sides of a drawer and each arm supports one of said runners 18, 19, which thus come to rest parallel with each other, as shown in FIG. 2.

Figure 3:
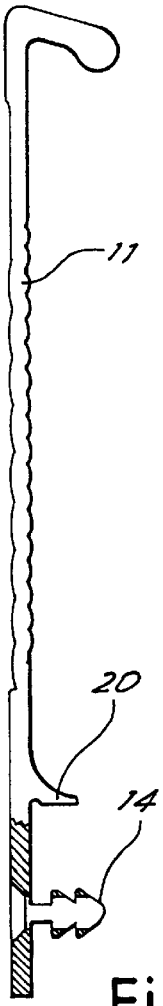
FIG. 3 shows a partial cutaway side view of a possible embodiment of a structural section forming part of the element of FIG. 1.

FIG. 3 shows an example of the profile of the strip 11. In this example, the rib 14 has a multiple arrow shape, with tapered lateral wings for a reliable coupling in a groove 16 in the grooved base 17, for example made of wood. Advantageously, the strip 11 has a further or second rib 20, made parallel to the first rib 14 (or coupling rib) and disposed on the side of the first rib remote from the lower edge of the strip.

FIGS. 4–7 show different embodiments of the strip 11 (indicated by references 111, 211, 311, 411). As can be clearly seen in FIG. 4 (where the strip, indicated by reference 111, is assembled with the other components of the element and coupled to the base 17 of the drawer), the second rib 20 provides an upper branch of the strip which overlies a portion of the upper surface of the base of the drawer when coupled in the first rib, so as to mask the seam inside the drawer between the strip and the base. As can also be seen in FIG. 4, the strip can also have a third rib 21, made parallel to the first and second rib and disposed close to the lower edge of the strip and cooperating with the second rib 20 to form a channel to receive the edge of a drawer base coupled with the first rib 14.

Figure 4:
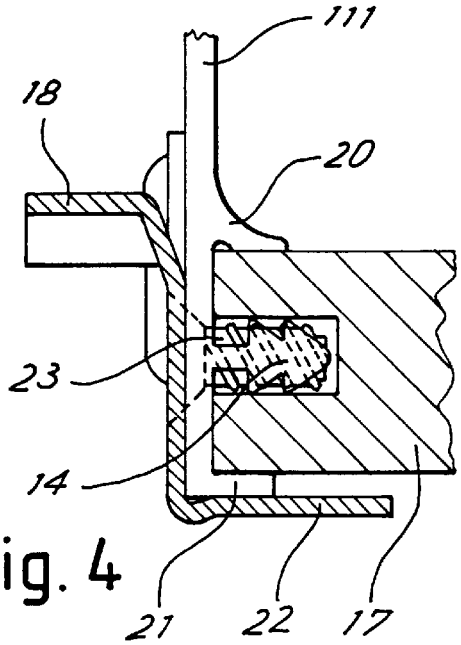
FIG. 4 shows a partial cutaway view of a first element for manufacturing a drawer, assembled with the structural section of FIG. 3.
Figure 5:
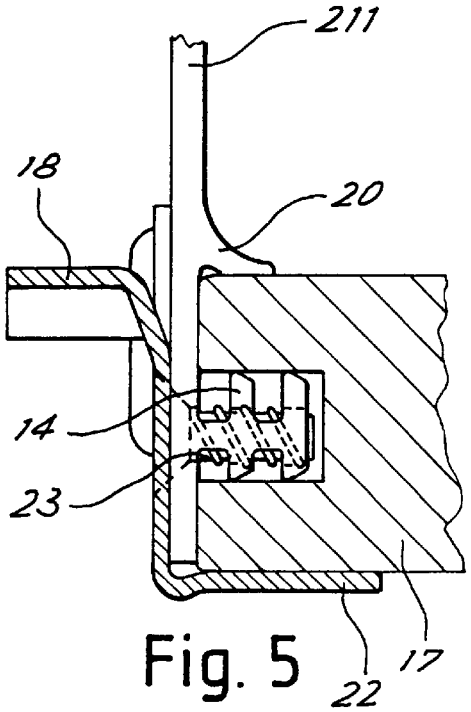
FIGS. 5 and 6 show partial cutaway views of a second and third element according to the invention.
Figure 6:
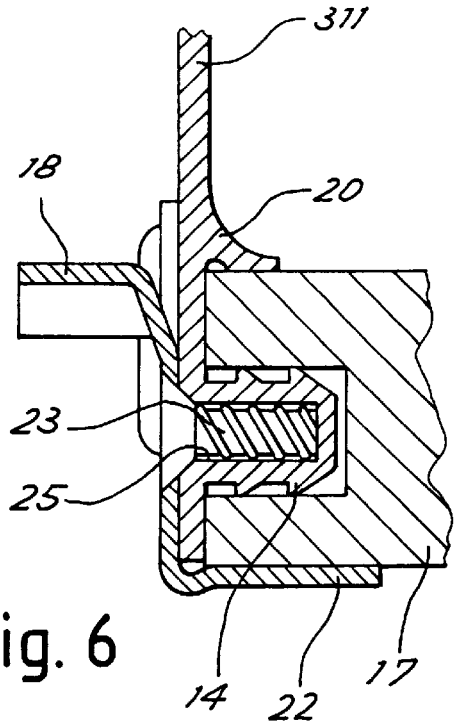

As can be seen in the variations on the embodiment of FIGS. 4, 5 and 6, the lower rib 21, can either supplemented by or completely replaced by extension 22 of the runners.

Figure 7:
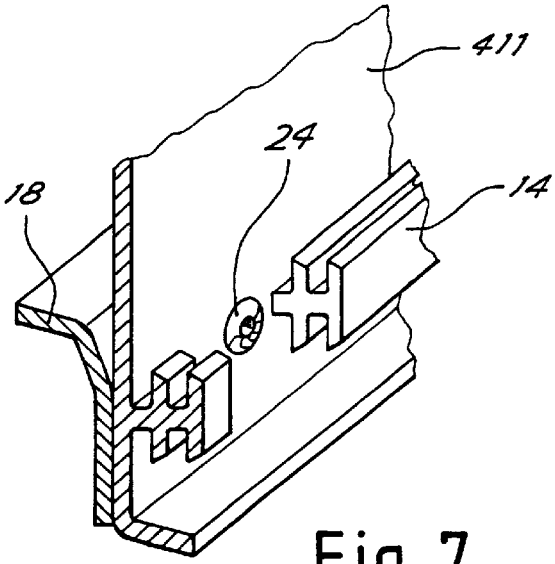
FIG. 7 shows a schematic perspective view of a fastening area of a different embodiment of an element according to the invention.

The fastening means securing the runners can comprise screws 23 (as in FIGS. 4, 5 and 6) or rivets 24 (as in FIG. 7).

To receive the fastening means, the coupling rib can be interrupted (for example by milling) in correspondence with the fastening means themselves, as shown by way of example in FIG. 7, or be simply drilled, as shown by way of example in FIG. 3. In both cases the fastening elements are partially contained within the cross-section of the coupling rib 14, according to the expression defined above.

In the variation of the embodiment in FIG. 6, the slots for the screws are obtained by means of a continuous groove 25 made in the thickness of the coupling rib. This can be easily achieved during the manufacture of the structural section forming the strip, thereby eliminating the need for subsequent drilling.

At this point it is clear that the intended scopes have been achieved by providing a simple rectilinear element 10 including pre-assembled runners. To assemble a drawer, all the user of the element 10 has to do is to fold it along the scored lines and fit the rib in a groove on the base of a drawer. No screws or rivets (or their housings) protrude inside the drawer or have to be applied by the user who makes the drawer. The means for fastening the runners are received by the peripheral groove in the base of the drawer. In the case of elements with three sides, such as in FIG. 2, the base 17, if desired, may have a groove 16 also in its rear edge to accommodate a rib section 14 on element 10, while the front side of the drawer can be made with a conventional front panel, for example in wood, applied subsequently.

The strip from which the element 10 is made is easily and inexpensively obtainable as a suitably cut continuous structural section, and this offers the possibility of producing an extremely sturdy, high quality element 10, at low cost.

The foregoing description of an embodiment applying the innovative principles of this invention is obviously given by way of example in order to illustrate such innovative principles and should not therefore be understood as a limitation to the sphere of the invention claimed herein. For example, as will be obvious to the expert in the field, the profile of the coupling rib can differ from the one shown.

What is claimed is:

1. An article for use in manufacturing a drawer including a base having opposed side edges, comprising an elongate strip disposed to be folded crosswise to its length along spaced scored lines therein to form the sides of a drawer, said strip having a first rib projecting from one face thereof close to one edge of the strip and extending longitudinally of the strip, said first rib being designed to fit into a groove formed in said side edges of the base of the drawer, and said strip having projecting from the opposite face thereof elongate strip runners secured to the strip by fastening means, said fastening means traversing the strip and being at least partially contained in part of said first rib.

2. An article as claimed in claim 1, characterized in that the scored lines in said strip are two in number to enable the strip to be folded into the shape of a U, so as to form opposing sides of a drawer with the arms of the U, each said arm supporting one of said runners.

3. An article as claimed in claim 1, characterized in that the fastening means comprises screws.

4. An article as claimed in claim 1, characterized in that the fastening means comprises rivets.

5. An article as claimed in claim 1, characterized in that the first rib is interrupted in part to accommodate the fastening means.

6. An article as claimed in claim 1, characterized in that the strip has, on said opposite face, a groove extending into the first rib to receive the fastening means for securing the runners.

7. An article as claimed in claim 1, characterized in that the strip has, on said one face, at least one further rib spaced from and parallel to the first rib and disposed at the side of the first rib remote from said one edge of the strip, so as to provide an upper branch of the strip that overlies part of the upper surface of a drawer base coupled with the first rib.

8. An article as claimed in claim 7, characterized in that the strip has, on said one face, a third rib made parallel to the first rib and disposed at the side of the first rib opposite said further rib, so as to form a channel containing said first rib, the channel being designed to receive the edge of a drawer base coupled with the first rib.

9. An article as claimed in claim 1, characterized in that the first rib has tapered lateral wings designed to fit into a groove in a side edge of a drawer base.

* * * * *